United States Patent [19]

Sueda et al.

[11] Patent Number: 5,048,737

[45] Date of Patent: Sep. 17, 1991

[54] MOTOR-DRIVEN TAPE CUTTER

[75] Inventors: Norio Sueda, Chiba; Yoshihiko Chino, Mitaka, both of Japan

[73] Assignee: Elm Industry Co., Ltd., Tokyo, Japan

[21] Appl. No.: 552,302

[22] Filed: Jul. 13, 1990

[30] Foreign Application Priority Data

Aug. 1, 1989 [JP] Japan ..... 1-90823[U]

[51] Int. Cl.[5] ..... B65H 17/26

[52] U.S. Cl. ..... 225/11; 225/18; 225/43; 225/53; 226/136

[58] Field of Search ..... 225/10, 11, 43, 26, 225/53, 89, 90, 18; 83/241; 226/134, 136

[56] References Cited

U.S. PATENT DOCUMENTS

| | | | |
|---|---|---|---|
| 2,822,046 | 2/1958 | Krueger | 225/11 |
| 3,128,024 | 4/1964 | Downham | 225/43 |
| 3,204,949 | 9/1965 | Kieslich | 225/11 |
| 3,384,280 | 5/1968 | Summersby | 225/43 |
| 3,690,531 | 9/1972 | Tanigami | 225/11 |
| 3,747,816 | 7/1973 | Se-Kit | 225/11 |
| 4,690,344 | 9/1987 | Yokota | 225/10 |

*Primary Examiner*—Frank T. Yost

*Assistant Examiner*—Scott A. Smith

*Attorney, Agent, or Firm*—Oblon, Spivak, McClelland, Maier & Neustadt

[57] ABSTRACT

In a motor-driven tape cutter including a cavity formed longitudinally on the upper side of a cutter body, a reel provided at one end of the cavity for supporting a ring-like roll of adhesive tape, a feed roller provided at the other end of the cavity for peeling and reeling out the leading end of the adhesive tape over a predetermined length, a backing roller and a presser roller adapted to grip the unreeled tape portion from opposite sides for straightening warping of the tape, a cutter blade for cutting the unreeled tape portion, a motor for driving the feed roller and the backing roller, a switch for actuating the motor, and a switch operating member which closes the switch in response to a tape cutting operation thereby reeling out a predetermined length of the ensuing tape portion, a cutter blade holder pivotally mounted on the front side of the cutter body to cover a fore end portion of the body cavity and at least part of the feed, backing and presser rollers and mounting the cutter blade and presser roller thereon, the cutter blade and pressing roller being moved away from the feed and backing rollers when the cutter blade holder is open.

3 Claims, 2 Drawing Sheets

MOTOR-DRIVEN TAPE CUTTER

BACKGROUND OF THE INVENTION

1. Field of the Invention

This invention relates to a motor-driven tape cutter which is arranged to reel out a predetermined length of adhesive tape from a ring-like roll automatically by motor power in relation with a tape cutting operation.

2. Description of the Prior Art

For example, as disclosed in Japanese Patent Publication No. 49-41678, it has been known in the art to provide a motor-driven tape cutter which is arranged to unreel a predetermined length of adhesive tape from a ring-like roll, which is supported on a reel, by means of a motor-driven feed roller, to rectify warping of the tape by imparting corrugations thereto through a backing roller and a presser roller before delivering the leading end of the tape to a tape outlet, and to cut the unreeled adhesive tape by pressing a cutter blade thereacross.

In the above-mentioned prior art tape cutter, when the the cutter blade is pushed against the tape for a cutting operation, the presser roller is once raised by the tension of the adhesive tape and allowed to drop by gravity as soon as the leading end of the tape is cut off. In relation with this upward and downward movements of the presser roller, a microswitch is operated through a switch operating means to actuate the motor, thereby automatically reeling out and transporting the ensuing tape portion toward the tape outlet. Therefore, each time the tape is cut, the ensuing portion of the adhesive tape is unreeled automatically to make the handling of the tape cutter very simple and convenient, except the following problems or drawbacks.

Namely, prior to using the cutter, it is normally necessary to peel off the leading tape end on the roll, which is mounted on the reel, and to thread the peeled leading end portion of the tape end around the feed roller and through a tape path between the presser and backing rollers, drawing the leading tape end out of the tape outlet. This tape threading job is troublesome and time consuming because it is necessary to hold the presser roller in a floated state while threading the tape along a predetermined tape path evading the cutting blade, and especially because the tape bears an adhesive layer which easily sticks to fingers or other surface in the vicinity of the tape path. Besides, due to narrowness of the spaces in the cutter, difficulties are often encountered in removing the adhesive tape which has stuck on the rollers, in cleaning contaminated rollers or in replacing a damaged cutting blade.

SUMMARY OF THE INVENTION

It is an object of the present invention to provide a motor-driven tape cutter which is constructed to facilitate the job of threading an adhesive tape through a predetermined path as well as the cleaning and cutter blade replacing jobs, namely, to provide a motor-driven tape cutter of easy maintenance and control.

In accordance with the present invention, the above-stated objective is achieved by a motor-driven tape cutter of the type including a cavity formed longitudinally on the upper side of a cutter body, a reel provided at one end of the cavity for supporting a ring-like roll of adhesive tape, a feed roller provided at the other end of the cavity for peeling and reeling out the leading end of the adhesive tape over a predetermined length, a backing roller and a presser roller adapted to grip the unreeled tape portion from opposite sides for straightening warping of the tape, a cutter blade for cutting the unreeled tape portion, a motor for driving the feed roller and the backing roller, a switch for actuating the motor, and a switch operating means adapted to close the switch in response to a tape cutting operation thereby reeling out a predetermined length of the ensuing tape portion, characterized in that the motor-driven tape cutter comprises: a cutter blade holder pivotally mounted on the front side of the cutter body to cover a fore end portion of the body cavity and at least part of the feed, backing and presser rollers and mounting the cutter blade and presser roller thereon, the cutter blade and pressing roller being moved away from the feed and backing rollers when the cutter blade holder is opened.

Accordingly, with the cutter construction of the invention, the holder is opened at the time of threading an adhesive tape along a tape path or when performing a cleaning job or replacing the cutter blade, whereupon the cutter blade and presser roller are moved away from the feed roller and backing roller to provide an ampler space for performing various jobs as mentioned above.

The holder is formed in an inverted L-shape to cover the front side and a fore end portion of the upper side of the cutter body cavity, and preferred to be pivotally connected at its lower end to the cutter body through a shaft so that the upper portion of the holder can be swung open away from the cutter body.

According to another aspect of the invention, the holder is provided with a tape outlet opening to the front side for drawing out the adhesive tape therethrough, means for fixedly supporting a cutting blade downwardly on the inner surface of its top wall, and a couple of vertical slots formed in its opposite side walls for displaceably receiving opposite end portions of the center shaft of the presser roller.

According to still another aspect of the invention, the holder is provided with projections on the inner surface of its lower end portion. When the holder is closed on the cutter body, the projections are fittingly engaged with circumferential grooves on the backing roller to prevent the adhesive tape on the backing roller from being caught and wound on the latter. In this instance, preferably the projections are arranged to be fitted in the grooves around the backing roller even when the holder is in opened state, for the purpose of preventing the adhesive tape from being wound around the backing roller when inadvertently transported forward while the holder is in opened state.

DESCRIPTION OF PREFERRED EMBODIMENTS

Figure 1:
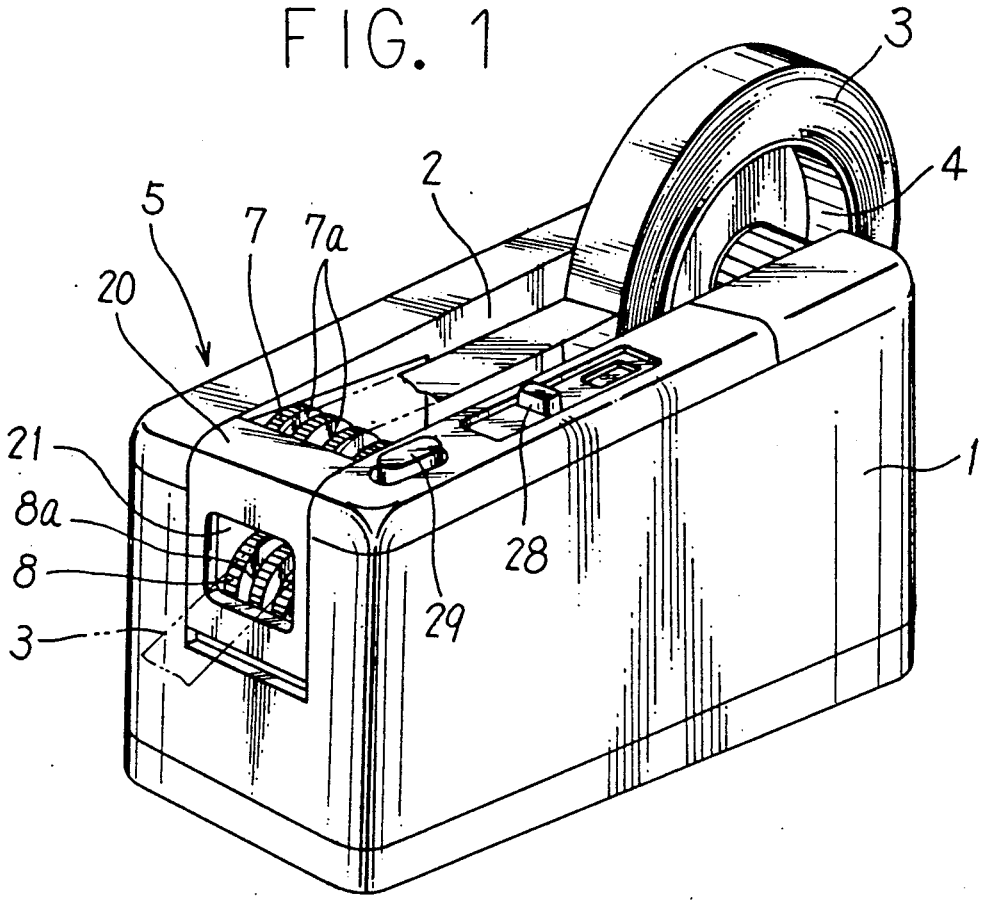
FIG. 1 is a perspective view of a tape cutter embodying the present invention.

Hereafter, the invention is described more particularly by way of the preferred embodiment shown in the drawings.

Figure 2:
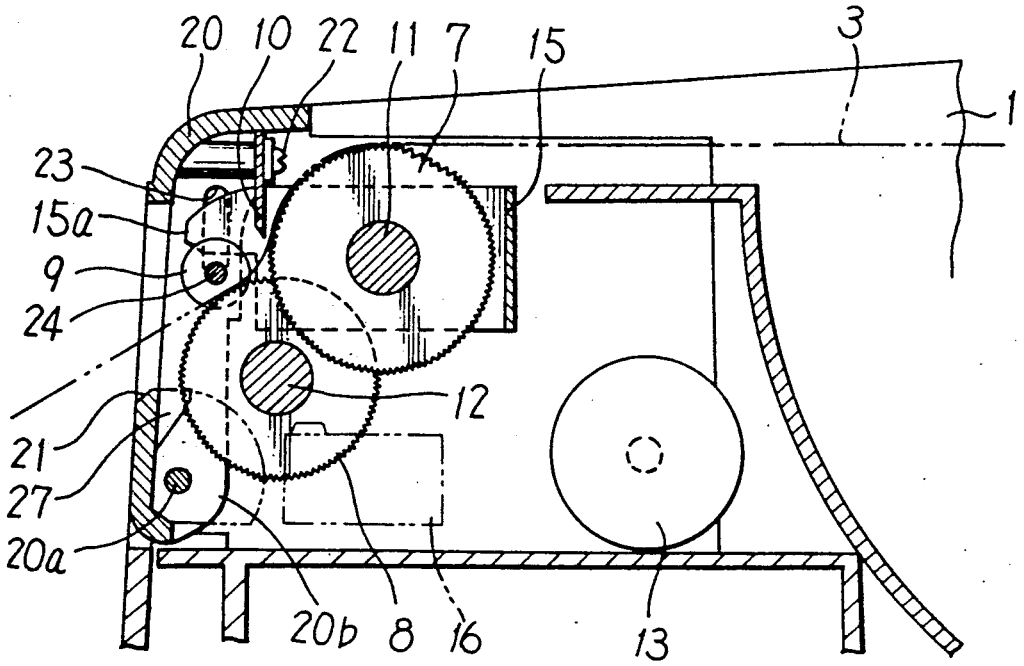
FIG. 2 is a sectional view on an enlarged scale of major components of the tape cutter.
Figure 3:
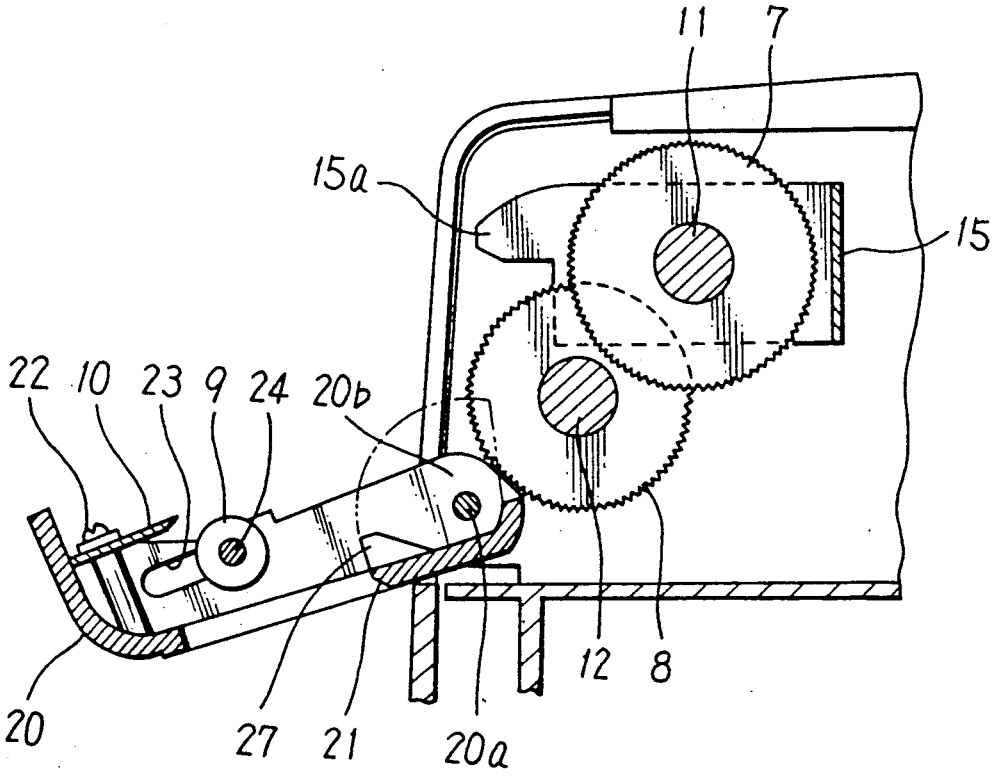
FIG. 3 is a view similar to FIG. 2 but showing the holder in opened state.

Referring to FIGS. 1 to 3, the reference 1 denotes a cutter body the top side of which is gradually inclined in the forward direction. The cutter body 1 is provided with a longitudinal cavity 2 centrally along the top side. A reel 4 is rotatably mounted across a rear end portion of the cavity 2 for supporting a ring-like roll of adhesive tape 3, while an unreeling/cutting mechanism 5 is provided in a front end portion of the cavity 2 for reeling out and cutting the adhesive tape.

The unreeling/cutting mechanism 5 includes a feed roller 7 which is provided with a plural number of annular grooves 7*a* around its circumference at predetermined intervals in the axial direction, a backing roller 8 which is provided with a plural number of grooves 8*a* around its circumference similarly at predetermined intervals in the axial direction and partially engaged with the feed roller 7 through the grooves 7*a* and 8*a* for rectification of warping of the tape, a presser roller 9 located upwardly displaceably over the backing roller 8 and partially engaged with the grooves 8*a* for rectification of tape warping, and a cutter blade 10 for cutting the adhesive tape. The circumferential surfaces of the feed and backing rollers 7 and 8 have suitable coarseness to prevent strong bondage of the adhesive tape.

The center shafts 11 and 12 of the feed and backing rollers 7 and 8 are rotatably supported on the side walls of the cavity 2, and connected to a motor 13 through a power transmission mechanism (not shown) which is provided internally of the cutter body 1 to drive the backing roller 8 slightly at a higher speed than the feed roller 7 in the unreeling direction. An operating member 15 of U-shape in section is rotatably supported on the shaft 11 of the feed roller 7 and biased to rotate counterclockwise by a spring, normally assuming the position shown in the drawing. The operating member 15 forms part of the switch operating means which depresses a microswitch 16, and, as the operating member 15 is turned about the roller shaft 11, the microswitch 16 is closed to actuate the motor 13. With respect ot the above-mentioned operating means, there have been proposed a diversity of means which can serve for this purpose, and therefore it is not intended to make discussions herein on any particular arrangement of the operating means.

On the other hand, the presser roller 9 and cutter blade 10 are supported on a cutter blade holder 20 which is pivotally mounted at the fore end of the cavity 2 to serve also as a cover which openably closes the front side of the cutter body 1. The holder cover 20 is formed in an inverted L-shape suitable for covering the front side and a fore end portion of the upper side of the cavity 2, and pivotally supported on the cutter body 1 through a shaft 20*a*. As shown particularly in FIG. 3, the upper portion of the holder 20 is turned away from the body 1 to open the front side of the cavity 2. The holder 20 is provided with a tape outlet 21 centrally on its front side for drawing out an adhesive tape therethrough. The cutter blade 10 is fixed by screws 22 on the inner surface of the top wall of the holder 20 such that the cutting edge of the blade is disposed downwardly. The holder 20 is provided with slots 23 in the opposite side walls 20*b* thereof for vertically displaceably receiving the opposite end portions of the center shaft 24 of the presser roller 9. When the holder 20 is closed as shown in FIG. 2, an engaging portion 15*a* of the operating member 15 is positioned on the center shaft 24 of the presser roller 9 such that the operating member 15 is turned clockwise by an upward movement of the presser roller 9.

Further, the holder cover 20 is provided with a plural number of projections 27 (normally a couple of parallel projections) on the inner surface of its lower end portion. These projections 27 are engaged with the circumferential grooves 8*a* on the backing roller 8 when the holder 20 is closed, thereby preventing the adhesive tape 3 from being seized and wound on the backing roller 8. The projections 27 may be so dimensioned as to remain in engagement with the grooves 8*a* of the backing roller 8 even when the holder 20 is opened as shown in phantom in FIG. 3, thereby preventing the tape 3 from being wound on the backing roller 8 on an occasion when the tape is inadvertently transported forward for some reason while the holder 20 is still in opened state.

With the tape cutter of the above-described construction, the tape 3 which is supported on the reel 4 is threaded along a predetermined tape path and drawn out of the tape outlet 21 prior to use. At this time, the holder 20 is held in opened state as shown in FIG. 3 to keep the cutter blade 10 and presser roller 9 on the holder 20 away from the feed and backing rollers 7 and 8, opening and ensuring easy access to the tape path along these rollers at the time of the tape threading operation.

In use, the holder 20 is closed as shown in FIGS. 1 and 2, and the leading end of the adhesive tape 3 which is led out through the tape outlet 21 is pulled up against the cutter blade 10 to cut off an adhesive tape strip of a desired length. At this time, the presser roller 9 is lifted by the tension of the adhesive tape 3, whereupon the engaging portion 15*a* of the operating member 15 is pushed up by the shaft 24 of the presser roller 9. As a result, the operating member 15 is turned clockwise about the shaft 11, and, after cutting the tape 3, it is returned to the position shown in the drawing together with the downward movement of the presser roller 9. By this rotational movement of the operating member 15, the microswitch 16 is depressed to actuate the motor 13, which drives the feed roller 7 through a predetermined angle to unreel and transport forward the ensuing tape portion automatically.

The length of the adhesive tape to be reeled out by the feed roller 7 is adjustable stepwise by switching the position of an adjusting member 28. The automatic unreeling function can be cancelled also by means of the adjusting member 28 when it is desired to unreel a necessary length of the adhesive tape by manually pressing a button switch 29.

When removing an adhesive tape 3 which has been wound around one of the rollers or when cleaning the rollers or when replacing a damaged cutter blade 10, the intended portion can be exposed to an ample open space to permit easy access thereto upon opening the holder 20.

What is claimed is:

1. A motor-driven tape cutter of the type including a cutter body having front and rear sides at longitudinal ends of said cutter body, a cavity elongated in the longitudinal direction on a top side of said cutter body, a reel provided at a longitudinal rear end of the cavity for supporting a ring-like roll of adhesive tape, a feed roller provided at a longitudinal front end of the cavity for peeling and reeling out the leading end of said adhesive tape over a predetermined length, a backing roller and a presser roller adapted to grip the unreeled tape portion from opposite sides for straightening warping of said tape, a cutter blade for cutting the unreeled tape portion, a motor for driving said feed roller and said backing roller, a switch for actuating said motor, and a switch operating means adapted to close said switch in relation with a tape cutting operation thereby reeling out a predetermined length of the ensuing tape portion, characterized in that said motor-driven tape cutter comprises:

a cutter blade holder pivotally mounted on the front side of the cutter body to openably close a longitudinal front end portion of said cavity and at least part of said feed, backing and presser rollers, and supporting said cutter blade and said presser roller thereon, said cutter blade and said presser roller being moved away from said feed and backing rollers when said cutter blade holder is opened;

wherein said holder is formed in an inverted L-shape at the longitudinal front end portion of said cavity, said holder being pivotally connected at a lower end portion thereof to said cutter body through a shaft, to permit said holder to be swung forward into an open position, said holder supporting said cutter blade and said presser roller thereon, said cutter blade and said presser roller being further from said feed and backing rollers when said holder is opened than when said holder is closed, wherein said holder is provided with projections on a lower end portion of said inner surface, that are fittingly engageable in circumferential grooves on said backing roller when said holder is closed and when said holder is open, thereby preventing said adhesive tape on said backing roller from being caught and wound on said backing roller.

2. A motor-driven tape cutter as defined in claim 1, wherein said holder is provided with a tape outlet on the front side of said cutter body for drawing out said adhesive tape therethrough, means for fixedly supporting a cutter blade downwardly on an inner surface of the top wall of said holder, and a couple of vertical slots formed in opposite side walls of said holder for displaceably receiving opposite end portions of a shaft of said presser roller.

3. A motor-driven tape cutter as defined in claim 2, wherein said presser roller is adapted to be displaced by the tension of said adhesive tape when said cutter blade is pressed thereagainst, thereby closing said switch through said switch operating means.

* * * * *